United States Patent [19]

Brown

[11] 4,118,060

[45] Oct. 3, 1978

[54] UNDERWATER RELEASE MECHANISM

[75] Inventor: Daniel Maitland Brown, San Diego, Calif.

[73] Assignee: The Regents of the University of California, Berkeley, Calif.

[21] Appl. No.: 787,694

[22] Filed: Apr. 14, 1977

[51] Int. Cl.[2] ..... B66C 1/00

[52] U.S. Cl. ..... 294/83 R; 294/66 R

[58] Field of Search ..... 294/83 R, 83 A, 66, 294/65.5; 24/230 R, 241 R; 335/286, 295; 361/144

[56] References Cited

U.S. PATENT DOCUMENTS

| | | | |
|---|---|---|---|
| 3,337,255 | 8/1967 | Nicoloff | 294/83 R |
| 3,504,407 | 4/1970 | Dawson | 294/66 R |
| 3,858,166 | 12/1974 | Hammond | 294/83 R |

*Primary Examiner*—James B. Marbert
*Attorney, Agent, or Firm*—Brown & Martin

[57] ABSTRACT

An underwater release mechanism, including a water-tight pressure housing; a trip hook assembly attached to the outside of the pressure housing for holding a load and operable for releasing the load; a permanent magnet movably positioned inside the housing and having both poles adjacent a given wall of the housing for transmitting a magnetic force through the wall; a motor inside the housing for moving the permanent magnet from a first position to a second position; a keeper attached to the trip hook assembly and held adjacent the given wall of the housing by the magnetic force transmitted through the wall when the permanent magnet is in the first position for preventing the trip hook assembly from releasing the load, wherein the keeper is movable from the wall to enable the trip hook assembly to release the load when the permanent magnet is moved to the second position; and steel bolts extending through the wall from the poles of the permanent magnet when the permanent magnet is in the first position for contacting the keeper and transmitting the magnetic force to the keeper when the keeper is adjacent the wall.

14 Claims, 8 Drawing Figures

UNDERWATER RELEASE MECHANISM

BACKGROUND OF THE INVENTION

The present invention pertains to underwater release mechanisms and is particularly directed to the operation of such a mechanism by a magnetic force.

An underwater release mechanism is a device that is operable in an underwater environment for releasing a load. A typical application for an underwater release mechanism is the opening and closing of nets. Another application is the release of an underwater instrument package from an anchor so as to enable the package to float to the surface.

Underwater release mechanisms are operated remotely. Such remote operation has been accomplished by using pressure compensated electrical motors and solenoids, explosive squibs, soluble wires or metals, or weights dropped down a supporting wire. Electro magnets and permanent magnets have also been used, but prior art systems including such require too much power or are too bulky to be used for the many routine needs.

Water, deep sea pressure, and salt all combine to make the operation of motors or solenoids quite expensive and frequently unreliable. Explosive squibs are reliable, but are expensive and can be dangerous.

It is the object of the present invention to provide a relatively inexpensive underwater release mechanism that is simple to operate and usuable at any predetermined ocean depth.

SUMMARY OF THE INVENTION

The underwater release mechanism of the present invention includes a watertight pressure housing; a releasable holding assembly attached to the outside of the pressure housing for holding a load and operable for releasing the load; a permanent magnet movably positioned inside the housing and having both poles adjacent a given wall of the housing for transmitting a magnetic force through the wall; a device inside the housing for moving the permanent magnet from a first position to a second position; a keeper attached to the releasable holding assembly and held adjacent the given wall of the housing by the magnetic force transmitted through the wall when the permanent magnet is moved to the second position; and rods of magnetic material extending through the wall from the poles of the permanent magnet when the permanent magnet is in the first position for contacting the keeper and transmitting the magnetic force to the keeper when the keeper is adjacent the wall.

Since the only force which comes from within the pressure housing is magnetic force, there are no high cost electrical plugs or conductors required. There is no pressure proofing required outside the housing as the releasable holding assembly is all mechanical, and usually made of stainless steel.

The underwater release mechanism is primarily useful for short term release operations wherein the release would be effected within less than twenty-four hours after the release mechanism is placed in the water.

Notwithstanding the problems of rust and electrolysis, the magnetic material rods preferably are steel bolts. The bolts are plated with nickel or chrome. Since the release mechanism is intended for only short term use, the amount of electrolysis that can take place is slight. Also the wall of the pressure housing through which the steel bolts extend consists of a non-magnetic material, such as an aluminum alloy. Even if the bolts become rusty, they still are effective in transmitting the magnetic force to the keeper.

The bolts have to be replaced periodically. However, such replacement costs considerably less than a single explosive squib. The underwater release mechanism of the present invention is reusuable whereas the explosive squib is not.

The underwater release mechanism of the present invention has been successfully tested in the Challenger Deep, which at approximately 6,000 fathoms is the deepest place on this planet.

Other features of the present invention are described with reference to the preferred embodiment.

DESCRIPTION OF THE PREFERRED EMBODIMENT

Figure 6:
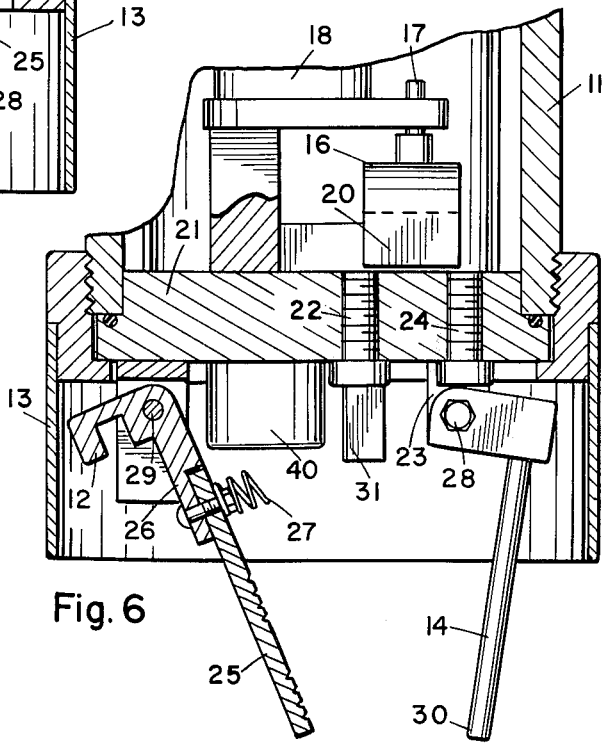
FIG. 6 is a sectional view similar to FIG. 5, but with the mechanism released.

Referring to the Drawings, a trip hook assembly 10 is attached to the outside of a watertight pressure holding 11. The trip hook assembly 10 includes a trip hook 12 and a release hook 14. A release ring 15 connected to a load is held on the release hook 14. When the trip hook assembly 10 is operated to release the load as shown in FIG. 6, the release ring 15 slides off the release hook 14 and the load is released. A pressure housing having walls that are approximately 2.5 cm. thick enables the release mechanism to be used at a depth of 6,000 fathoms. The housing 11 includes a skirt 13 for shielding the trip hook assembly 10.

Figure 1:
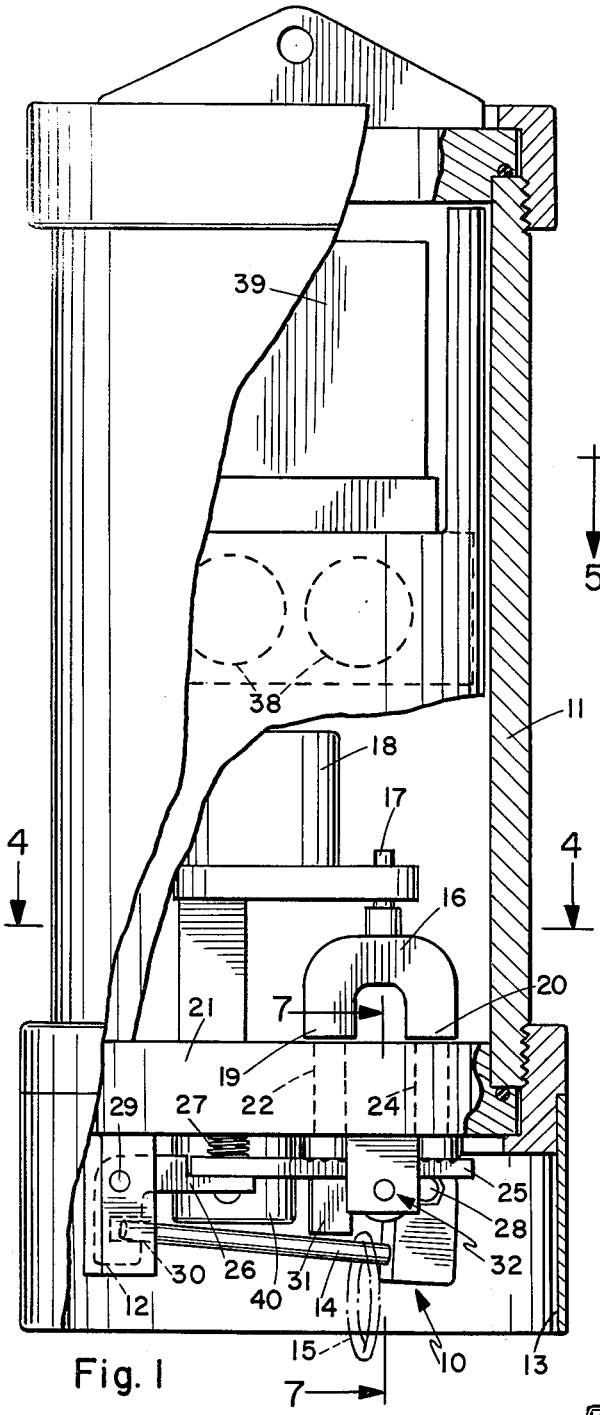
FIG. 1 is a side elevation view of the complete unit, with portions cut away.
Figure 2:
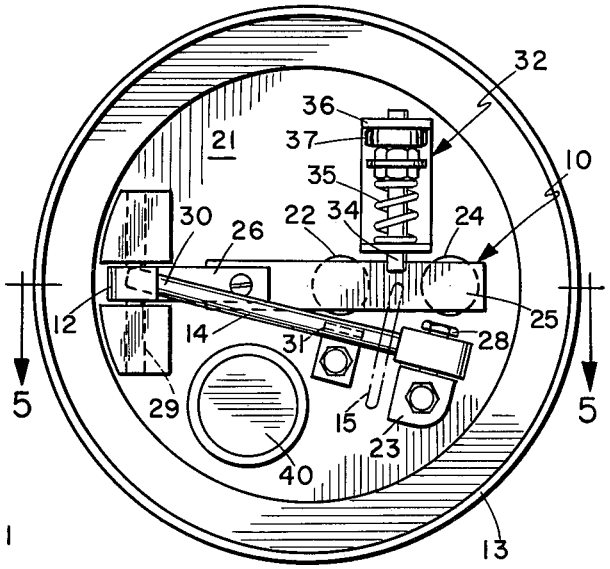
FIG. 2 is an end elevation view from below FIG. 1.
Figure 4A:
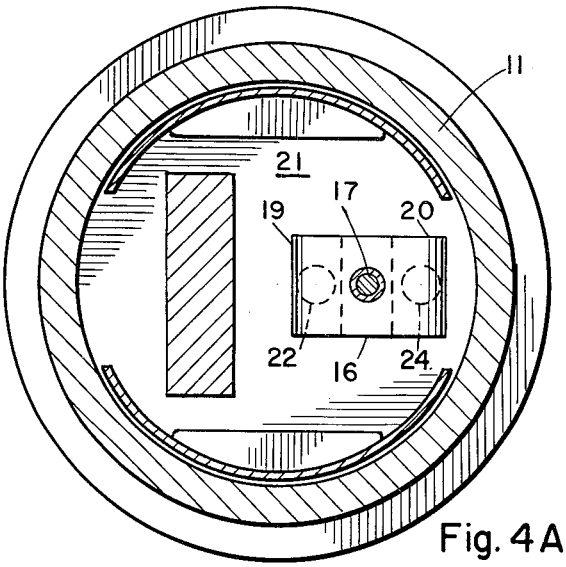
FIGS. 4A and 4B are similar sectional views taken on line 4—4 of FIG. 1, showing the two positions of the retaining magnet.
Figure 4B:
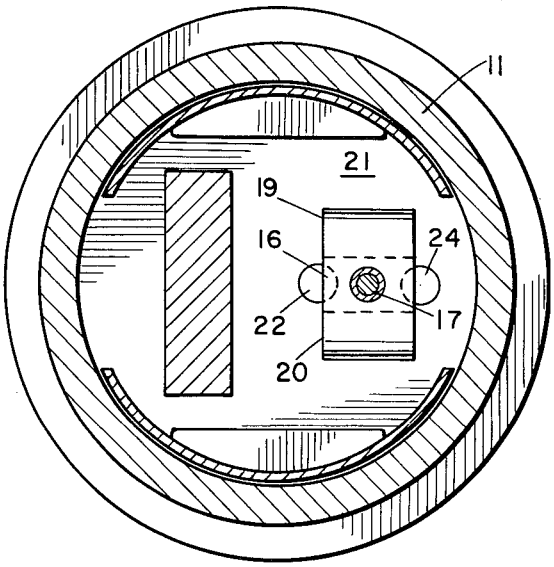
Figure 5:
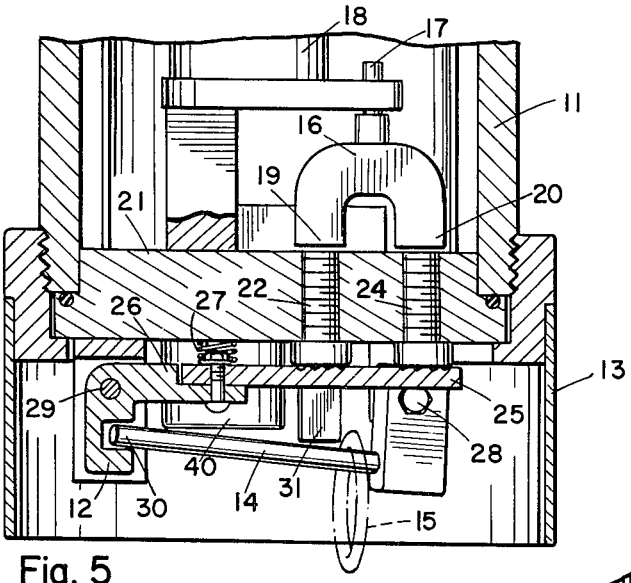
FIG. 5 is a sectional view taken on line 5—5 of FIG. 2.

A permanent magnet 16 is movably positioned in the housing 11. The magnet 16 is connected to the output shaft 17 of a motor 18. The motor 18 is operably for moving the permanent magnet 16 from a first position, as shown in FIGS. 1 and 4A to a second position as shown in FIG. 4B. The permanent magnet 16 has both poles 19, 20 adjacent a wall 21 of the housing 10 for transmitting a magnetic force through the wall 21.

Two steel bolts 22, 24 extend through the wall 21. The bolts 22, 24 are positioned adjacent the poles 19, 20 of the magnet 16 when the magnet 16 is in the first position for transmitting the magnetic force of the magnet 16 through the wall 21. Each bolt 22, 24 has an "O" ring (not shown) under the bolt head to prevent water from being forced down the bolt threads. Each bolt 22, 24 is nickel plated to reduce corrosion potential. Minimal clearance is provided between the poles 10, 20 and the bolts 22, 24.

A nickel plated steel keeper 25 is attached to the trip hook 12 by means of a bar 26. The keeper 25 is positioned for contact with the bolts 22, 24 extending through the wall 21, and is held adjacent the wall 21 by the magnetic force transmitted through the wall 21 by the bolts 22, 24 when the permanent magnet 16 is in the first position (FIGS. 1 and 4A). The surface of the keeper 25 that makes contact with the bolts 22, 24 is grooved to prevent a deep sea pressure lock between the keeper and the bolts.

When the permanent magnet 16 is rotated through about 100° to the second position by the motor 18, the poles 19, 20 are no longer adjacent the steel bolts 22, 24, and as a result the magnetic force of the magnet 16 is no longer transmitted by the steel bolts 22, 24 to the keeper 25 so as to hold the keeper 25 adjacent the wall 21. Thus the keeper 25 is free to fall away from its position adjacent the wall 21 when the underwater release mechanism is positioned vertically as shown in FIG. 1.

However, since the underwater release mechanism is not vertically positioned for all applications, and the load may be too light to spring the trip hook assembly 10, a compression spring 27 is positioned between the keeper 25 and the wall 21. The compression spring 27 forces the keeper 25 away from its position adjacent the wall 21 when the permanent magnet 16 is moved to the second position, thereby removing the magnetic force from the keeper 25.

As shown in FIG. 6, when the keeper 25 is removed from its position adjacent the wall 21, the trip hook 12 is enabled to release the release hook 14, thereby releasing the release ring 15 and the load to which the ring 15 is connected.

The combination of the trip hook assembly 10 and the keeper 25 constitutes a force amplifier which provides a holding force against the load that is a multiple of the magnetic force provided by the permanent magnet 16.

The permanenet magnet 16 is a "1 inch" magnet. The one inch magnet generates only about 0.5 Kg of force when transmitting through the 2.5 cm thickness of the wall 21 to the keeper 25. The trip hook assembly 10 is designed for this 0.5 Kg force.

To amplify a 0.5 Kg force into a usuable force requires a very carefully designed trip hook assembly. A small force can support a large load when there is a great difference between the relative lever arms. The fulcrum of the trip hook 12 in this case is the center of the trip hook axle pin 29. The load force exerted by the end 30 of the release hook 14 acts almost through the center of the axle pin 29. The release hook 14 is mounted on a bracket 23 and pivots about a hinge pin 28. A retaining stop 31 fixed on the wall 21 is spaced from the bracket 23 and extends to substantially meet the release hook 14 to thereby confine the release ring 15 to a position adjacent the hinge pin 28 so that the load held by the ring 15 is applied very close to the fulcrum of the release hook 14. With such a small lever arm on both the trip hook 12 and the release hook 14, a large force can be held by the 0.5 Kg magnetic force acting over the relatively large lever arm provided by the keeper 25 and the bar 26. The concept is very simple but is often overlooked. Theoretical load capacity is in the tons, but material strength limits the actual capability. With the trip hook configuration shown in the Drawing, a force of 150 Kg can be supported before the magnet 16 loses its grip. This embodiment will support a ballast load of about 50 Kg and a spring tension load of about 150 Kg.

There is one kind of failure inherent in magnetized steel; that failure being provided by a sharp shock. The magnetic field from the permanent magnet 16 can be momentarily thrown into disarray by a sharp shock, and thereby cause an unwanted premature release of the load by the release mechanism. If launching shocks are expected, then a small spring loaded safety device 32 should be used to retain the keeper 25 in its position adjacent the wall 21 in contact with the bolts 22, 24 while the release mechanism is out of the water.

Figure 3:
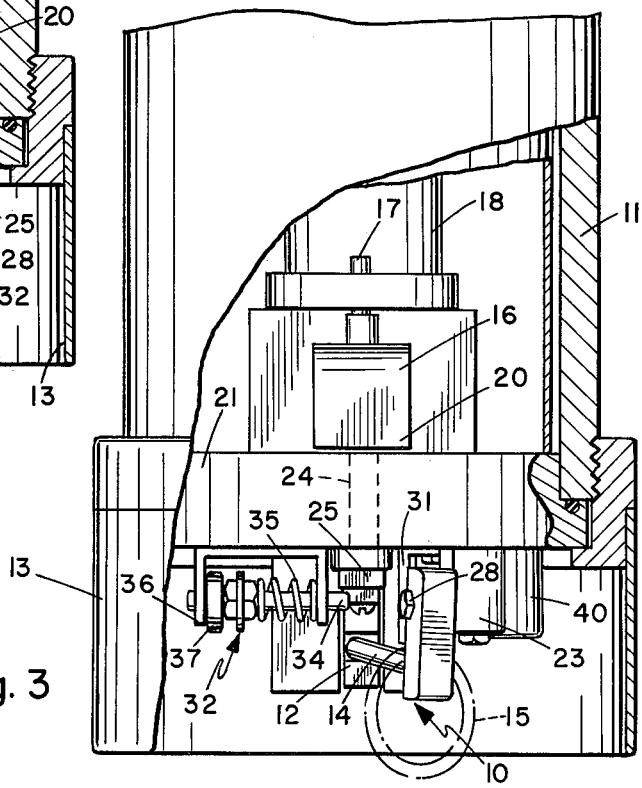
FIG. 3 is a side elevation view as taken from the right side of FIG. 1, with portions cut away.
Figure 7:
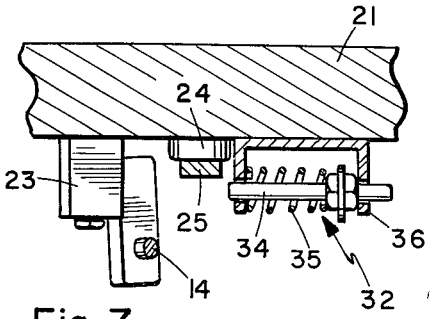
FIG. 7 is a sectional view taken on line 7—7 of FIG. 1, showing the safety device released.

The safety device 32 includes a bar 34 positioned for movement between a first position (FIG. 3) over the keeper 25 for preventing movement of the keeper 25 away from the wall 21 and a second position (FIG. 7) away from the keeper 25.

A compression spring 35 is attached to the bar 34 for biasing the bar for movement from the first position to said second position.

A stop 36 stops movement of the bar 34 in the second position when the bar 34 is moved from the first position by the spring 35.

A water soluble element 37, such as a Life Saver candy is positioned between the bar 34 and the stop 36 to hold the bar in the first position over the keeper 25 while the underwater release mechanism is out of the water. This safety device 32 prevents the keeper 25 from disengaging from the bolts 22, 24 until after the water soluble element 37 has dissolved, which takes about 10 minutes for a Life Saver candy in sea water.

The pressure housing 11 also contains a battery (or batteries) 38 for providing power to the motor 18 and a switching mechanism 39 which is connected to the motor 18 for turning on the motor 18 to initiate movement of the permanent magnet 16.

Two types of switching mechanisms 39 have been used. One is a spring wound time switch which is set by simply twisting the dial to the desired time. The only problem with such timers is their accuracy, which is around five percent of full scale. These timers can be started on deck before closing them up inside the pressure housing 11. They are quite inexpensive and they are available with full scale dials ranging from minutes to twelve hours, which is sufficient for most needs. With this type of switching mechanism, the only electrical power needed is that of a 9 volt "transistor" battery to operate the motor 18. Once the switching mechanism 39 is turned on, it stays on, and the battery is consumed.

The other type of switching mechanism 39 is a solid state timer, which has timing intervals selected by a switch code. In this embodiment two 12 volt "transistor" batteries 38 power the timer 39 and the motor 18. It is possible to program the solid state timer to run long enough to cause a release, then turn off, thus saving the 12 volt transistor batteries 38 for additional use.

These solid state timers are quartz crystal controlled and are quite accurate. They can also be turned on electrically, thus permitting the use of pressure or tilt switches to start the timing sequence. The preferred embodiment includes a pressure sensing switch 40 attached to the outside of the housing 11, to actuate the timer 39 and start the timing sequence upon sensing at least that pressure in the environment outside the housing 11 which is present at a predetermined depth, such as 20 meters.

An all mechanical clockwork system (not shown) working much like an alarm clock can also be used to rotate the permanent magnet 16 in lieu of the motor 18, thereby eliminating the need for batteries altogether.

Because there is a quality control problem in the manufacture of batteries, it is preferred to use two batteries 38 in parallel to provide reliability.

The mechanical clocks are subject to additional error due to vibration of the escapement when used on towed vehicles. If vibration is expected to be a factor, then the solid state timer is preferred.

Having described my invention, I now claim:

1. An underwater release mechanism, comprising
a watertight pressure housing;
releasable holding means attached to the outside of the pressure housing for holding a load and operable for releasing said load;
a permanent magnet movably positioned inside the housing and having both poles adjacent a given wall of the housing for transmitting a magnetic force through the wall;
means inside the housing for moving the permanent magnet from a first position to a second position;
a keeper attached to the releasable holding means and held adjacent the given wall of the housing by said magnetic force transmitted through the wall when the permanent magnet is in said first position for preventing the releasable holding means from releasing said load, wherein the keeper is movable from the wall to enable the releasable holding means to release said load when the permanent magnet is moved to said second position; and
rods of magnetic material extending through the wall from the poles of the permanent magnet when the permanent magnet is in said first position for contacting the keeper and transmitting said magnetic force to the keeper when the keeper is adjacent the wall.

2. An underwater release mechanism according to claim 1, wherein the combination of the releasable means for holding the load and the keeper held against the wall by said magnetic force constitutes a force amplifier for providing a holding force against said load that is a multiple of said magnetic force.

3. An underwater release mechanism according to claim 2, wherein the releasable means comprises a trip hook assembly.

4. An underwater release mechanism according to claim 1, further comprising a compression spring positioned between the keeper and the wall for forcing the keeper away from the wall when the permanent magnet is moved to said second position.

5. An underwater release mechanism according to claim 1, wherein the keeper includes a grooved surface for contact with the rods.

6. An underwater release mechanism according to claim 1, wherein the magnetic material is steel.

7. An underwater release mechanism according to claim 1, wherein the rods are steel bolts.

8. An underwater release mechanism according to claim 1, further comprising switching means inside the housing connected to the means for moving the permanent magnet for initiating movement of the permanent magnet.

9. An underwater release mechanism according to claim 8, further comprising clock means inside the housing connected to the switching means to initiate movement of the permanent magnet at a predetermined time following actuation of the clock means.

10. An underwater release mechanism according to claim 9, further comprising pressure sensing means attached to the outside of the housing and connected to the clock means for actuating the clock means upon sensing at least a predetermined pressure in the environment outside the housing.

11. An underwater release mechanism according to claim 8, further comprising pressure sensing means attached to the outside of the housing and coupled to the switching means for causing the switching means to initiate movement of the permanent magnet in response to the pressure sensing means sensing at least a predetermined pressure in the environment outside the housing.

12. An underwater release mechanism according to claim 1, wherein the wall consists of non-magnetic material.

13. An underwater release mechanism according to claim 1, wherein the wall consists of an aluminum alloy, and the rods are steel bolts.

14. An underwater release mechanism according to claim 1, further comprising a device for holding the keeper adjacent the housing wall in contact with the rods when the underwater release mechanism is out of the water, said device comprising
a bar positioned for movement between a first position over the keeper for preventing movement of the keeper away from the wall and a second position away from the keeper;
a spring attached to the bar for biasing the bar for movement from said first position to said second position; and
a stop for stopping movement of the bar in said second position when the bar is moved from said first position by the spring;
whereby when a water soluble element is positioned between the bar and the stop the bar is held in said first position over the keeper.

* * * * *